US008977545B2

(12) United States Patent
Zeng et al.

(10) Patent No.: US 8,977,545 B2
(45) **Date of Patent: *Mar. 10, 2015**

(54) SYSTEM AND METHOD FOR MULTI-CHANNEL NOISE SUPPRESSION

(75) Inventors: Huaiyu Zeng, Red Bank, NJ (US); Jes Thyssen, San Juan Capistrano, CA (US); Nelson Sollenberger, Farmingdale, NJ (US); Juin-Hwey Chen, Irvine, CA (US); Xianxian Zhang, San Diego, CA (US)

(73) Assignee: Broadcom Corporation, Irvine, CA (US)

( * ) Notice: Subject to any disclaimer, the term of this patent is extended or adjusted under 35 U.S.C. 154(b) by 634 days.

This patent is subject to a terminal disclaimer.

(21) Appl. No.: 13/295,889

(22) Filed: Nov. 14, 2011

(65) Prior Publication Data

US 2012/0123773 A1 May 17, 2012

Related U.S. Application Data

(60) Provisional application No. 61/413,231, filed on Nov. 12, 2010.

(51) Int. Cl.

| | |
|---|---|
| ***G10L 21/02*** | (2013.01) |
| ***G10L 21/0208*** | (2013.01) |
| ***G10L 21/0272*** | (2013.01) |

(Continued)

(52) U.S. Cl.

CPC ..... *G10L 21/0208* (2013.01); *G10L 21/0272* (2013.01); *G10L 2021/02165* (2013.01); *H04R 1/245* (2013.01); *H04R 2410/07* (2013.01)

USPC ..... 704/226; 704/227; 704/223; 704/225; 704/228; 381/94.1; 381/94.7; 381/71.1; 379/406.08

(58) Field of Classification Search

CPC ..... G10L 2021/02165; G10L 2021/02085; G10L 2021/02161; G10L 21/0208; G10L 21/0272; G10L 21/0216; G10L 21/034; G10L 21/0364; G10L 25/78; G10L 25/90; H04R 3/005; H04R 2410/07; H04R 2499/13; H04R 3/02

USPC ..... 704/226–227, 233, 225, 203, 207; 381/94.1–94.3, 94.7, 320, 321, 317, 381/71.1; 379/406.08, 395

See application file for complete search history.

(56) References Cited

U.S. PATENT DOCUMENTS

| | | | | |
|---|---|---|---|---|
| 4,570,746 | A * | 2/1986 | Das et al. | 381/359 |
| 4,600,077 | A * | 7/1986 | Drever | 181/242 |
| 5,288,955 | A * | 2/1994 | Staple et al. | 181/158 |

(Continued)

*Primary Examiner* — Vijay B Chawan

(74) *Attorney, Agent, or Firm* — Sterne, Kessler, Goldstein & Fox P.L.L.C.

(57) ABSTRACT

Described herein are multi-channel noise suppression systems and methods that are configured to detect and suppress wind and background noise using at least two spatially separated microphones: at least one primary speech microphone and at least one noise reference microphone. The multi-channel noise suppression systems and methods are configured, in at least one example, to first detect and suppress wind noise in the input speech signal picked up by the primary speech microphone and, potentially, the input speech signal picked up by the noise reference microphone. Following wind noise detection and suppression, the multi-channel noise suppression systems and methods are configured to perform further noise suppression in two stages: a first linear processing stage that includes a blocking matrix and an adaptive noise canceler, followed by a second non-linear processing stage.

24 Claims, 5 Drawing Sheets

(51) Int. Cl.
*H04R 1/24* (2006.01)
*G10L 21/0216* (2013.01)

(56) References Cited

U.S. PATENT DOCUMENTS

| | | | | |
|---|---|---|---|---|
| 5,550,924 | A * | 8/1996 | Helf et al. | 381/94.3 |
| 5,574,824 | A * | 11/1996 | Slyh et al. | 704/226 |
| 5,757,937 | A * | 5/1998 | Itoh et al. | 381/94.3 |
| 5,943,429 | A * | 8/1999 | Handel | 381/94.2 |
| 6,230,123 | B1 * | 5/2001 | Mekuria et al. | 704/226 |
| 7,099,821 | B2 | 8/2006 | Visser et al. | |
| 7,359,504 | B1 * | 4/2008 | Reuss et al. | 379/406.02 |
| 7,464,029 | B2 | 12/2008 | Visser et al. | |
| 7,617,099 | B2 * | 11/2009 | Yang et al. | 704/228 |
| 7,916,882 | B2 | 3/2011 | Pedersen et al. | |
| 7,949,520 | B2 * | 5/2011 | Nongpiur et al. | 704/207 |
| 7,983,907 | B2 * | 7/2011 | Visser et al. | 704/227 |
| 8,150,682 | B2 * | 4/2012 | Nongpiur et al. | 704/207 |
| 8,340,309 | B2 * | 12/2012 | Burnett et al. | 381/71.6 |
| 8,374,358 | B2 | 2/2013 | Buck et al. | |
| 8,452,023 | B2 | 5/2013 | Petit et al. | |
| 8,515,097 | B2 * | 8/2013 | Nemer et al. | 381/94.1 |
| 2005/0036629 | A1 * | 2/2005 | Aubauer et al. | 381/71.1 |
| 2006/0193671 | A1 | 8/2006 | Yoshizawa et al. | |
| 2007/0021958 | A1 * | 1/2007 | Visser et al. | 704/226 |
| 2007/0030989 | A1 | 2/2007 | Kates | |
| 2007/0033029 | A1 | 2/2007 | Sakawaki | |
| 2008/0025527 | A1 * | 1/2008 | Haulick et al. | 381/93 |
| 2008/0033584 | A1 | 2/2008 | Zopf et al. | |
| 2008/0046248 | A1 | 2/2008 | Chen et al. | |
| 2008/0201138 | A1 * | 8/2008 | Visser et al. | 704/227 |
| 2010/0008519 | A1 | 1/2010 | Hayakawa et al. | |
| 2010/0223054 | A1 * | 9/2010 | Nemer et al. | 704/219 |
| 2010/0254541 | A1 | 10/2010 | Hayakawa | |
| 2010/0260346 | A1 | 10/2010 | Takano et al. | |
| 2011/0038489 | A1 | 2/2011 | Visser et al. | |
| 2011/0099007 | A1 | 4/2011 | Zhang | |
| 2011/0099010 | A1 | 4/2011 | Zhang | |
| 2011/0103626 | A1 | 5/2011 | Bisgaard et al. | |
| 2012/0010882 | A1 | 1/2012 | Thyssen et al. | |
| 2012/0121100 | A1 * | 5/2012 | Zhang et al. | 381/71.1 |
| 2012/0123771 | A1 * | 5/2012 | Chen et al. | 704/226 |
| 2012/0123772 | A1 | 5/2012 | Thyssen et al. | |
| 2013/0044872 | A1 | 2/2013 | Eriksson et al. | |
| 2013/0211830 | A1 | 8/2013 | Petit et al. | |

* cited by examiner

SYSTEM AND METHOD FOR MULTI-CHANNEL NOISE SUPPRESSION

CROSS REFERENCE TO RELATED APPLICATIONS

This application claims the benefit of U.S. Provisional Patent Application No. 61/413,231, filed on Nov. 12, 2010, which is incorporated herein by reference in its entirety.

FIELD OF THE INVENTION

This application relates generally to systems that process audio signals, such as speech signals, to remove undesired noise components therefrom.

BACKGROUND

An input speech signal picked up by a microphone can be corrupted by acoustic noise present in the environment surrounding the microphone (also referred to as background noise). If no attempt is made to mitigate the impact of the noise, the corruption of the input speech signal will result in a degradation of the perceived quality and intelligibility of its desired speech component when played back to a listener. The corruption of the input speech signal can also adversely impact the performance of speech coding and recognition algorithms.

One additional source of noise that can corrupt the input speech signal picked up by the microphone is wind. Wind causes turbulence in air flow and, if this turbulence impacts the microphone, it can result in the microphone picking up sound referred to as "wind noise." In general, wind noise is bursty in nature and can last from a few milliseconds up to a few hundred milliseconds or more. Because wind noise is impulsive and can exceed the nominal amplitude of the desired speech component in the input speech signal, the presence of such noise will further degrade the perceived quality and intelligibility of the desired speech component when played back to a listener.

Therefore, what is needed is a system and method that can effectively detect and suppress wind and background noise components in an input speech signal to improve the perceived quality and intelligibility of a desired speech component in the input speech signal when played back to a listener.

BRIEF DESCRIPTION OF THE DRAWINGS/FIGURES

The accompanying drawings, which are incorporated herein and form a part of the specification, illustrate the present invention and, together with the description, further serve to explain the principles of the invention and to enable a person skilled in the pertinent art to make and use the invention.

The present invention will be described with reference to the accompanying drawings. The drawing in which an element first appears is typically indicated by the leftmost digit(s) in the corresponding reference number.

DETAILED DESCRIPTION

1. Introduction

Figure 1:
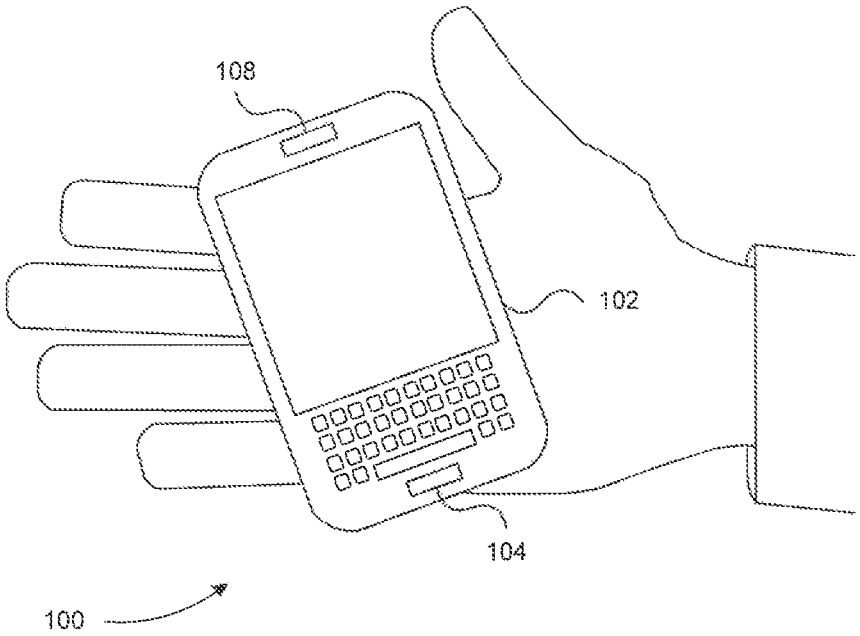
FIG. 1 illustrates a front view of an example wireless communication device in which embodiments of the preset invention can be implemented.

In the following description, numerous specific details are set forth in order to provide a thorough understanding of the invention. However, it will be apparent to those skilled in the art that the invention, including structures, systems, and methods, may be practiced without these specific details. The description and representation herein are the common means used by those experienced or skilled in the art to most effectively convey the substance of their work to others skilled in the art. In other instances, well-known methods, procedures, components, and circuitry have not been described in detail to avoid unnecessarily obscuring aspects of the invention.

References in the specification to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

As noted in the background section above, wind and background noise can corrupt an input speech signal picked up by a microphone, resulting in a degradation of the perceived quality and intelligibility of a desired speech component in the input speech signal when played back to a listener. Described herein are multi-channel noise suppression systems and methods that are configured to detect and suppress wind and background noise using at least two spatially separated microphones: a primary speech microphone and at least one noise reference microphone. The primary speech microphone is positioned to be close to a desired speech source during regular use of the multi-microphone system in which it is implemented, whereas the noise reference microphone is positioned to be farther from the desired speech source during regular use of the multi-microphone system in which it is further implemented.

In embodiments, the multi-channel noise suppression systems and methods are configured to first detect and suppress wind noise in the input speech signal picked up by the primary speech microphone and, potentially, the input speech signal picked up by the noise reference microphone. Following wind noise detection and suppression, the multi-channel noise suppression systems and methods are configured to perform further noise suppression in two stages: a first linear processing stage followed by a second non-linear processing stage. The linear processing stage performs background noise suppression using a blocking matrix (BM) and an adaptive noise canceler (ANC). The BM is configured to remove desired speech in the input speech signal received by the noise reference microphone to get a "cleaner" background noise component. Then, the ANC is used to remove the background noise in the input speech signal received by the primary speech microphone based on the "cleaner" background noise component to provide a noise suppressed input speech signal. The non-linear processing stage follows the linear processing stage and is configured to suppress any residual wind and/or background noise present in the noise suppressed input speech signal.

Before describing further details of the multi-channel noise suppression systems and methods of the present invention, the discussion below begins by providing an example multi-microphone communication device and multi-microphone speech communication system in which embodiments of the present invention can be implemented.

2. Example Operating Environment

Figure 2:
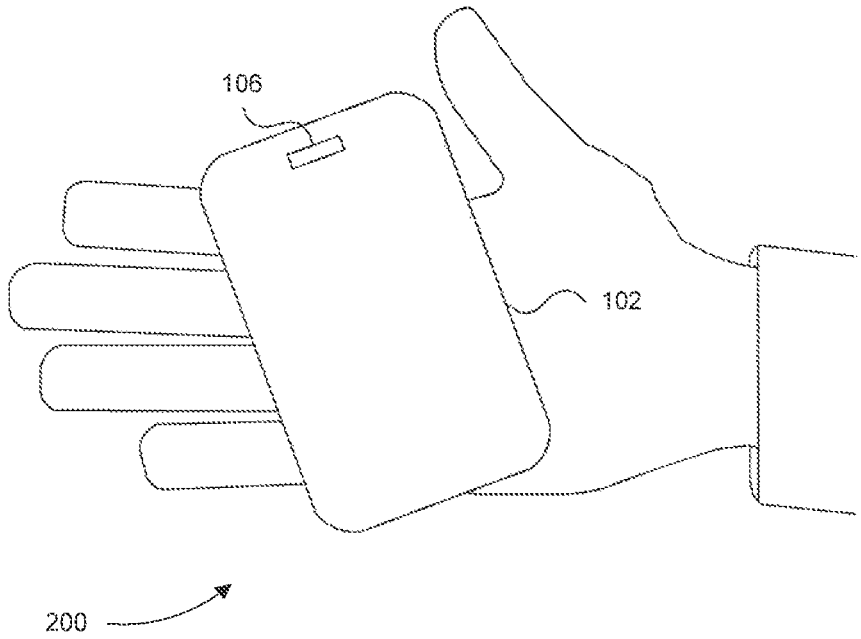
FIG. 2 illustrates a back view of the example wireless communication device shown in FIG. 1.

FIGS. 1 and 2 respectively illustrate a front portion 100 and a back portion 200 of an example wireless communication device 102 in which embodiments of the present invention can be implemented. Wireless communication device 102 can be a personal digital assistant (PDA), a cellular telephone, or a tablet computer, for example.

As shown in FIG. 1, front portion 100 of wireless communication device 102 includes a primary speech microphone 104 that is positioned to be close to a user's mouth during regular use of wireless communication device 102. Accordingly, primary speech microphone 104 is positioned to capture the user's speech (i.e., the desired speech). As shown in FIG. 2, a back portion 200 of wireless communication device 102 includes a noise reference microphone 106 that is positioned to be farther from the user's mouth during regular use than primary speech microphone 104. For instance, noise reference microphone 106 can be positioned as far from the user's mouth during regular use as possible.

Although the input speech signals received by primary speech microphone 104 and noise reference microphone 106 will each contain desired speech and background noise, by positioning primary speech microphone 104 so that it is closer to the user's mouth than noise reference microphone 106 during regular use, the level of the user's speech that is captured by primary speech microphone 104 is likely to be greater than the level of the user's speech that is captured by noise reference microphone 106, while the background noise levels captured by each microphone should be about the same. This information can be exploited to effectively suppress background noise as will be described below in regard to FIG. 4.

In addition, because the two microphones 104 and 106 are spatially separated, wind noise picked up by one of the two microphones often will not be picked up (or at least not to the same extent) by the other microphone. This is because air turbulence caused by wind is usually a fairly local event unlike sound based pressure waves that go everywhere. This fact can be exploited to detect and suppress wind noise as will be further described below in regard to FIG. 4.

Front portion 100 of wireless communication device 102 can further include, in at least one embodiment, a speaker 108 that is configured to produce sound in response to an audio signal received, for example, from a person located at a remote distance from wireless communication device 102.

It should be noted that primary speech microphone 104 and noise reference microphone 106 are shown to be positioned on the respective front and back portions of wireless communication device 102 for illustrative purposes only and is not intended to be limiting. Persons skilled in the relevant art(s) will recognize that primary speech microphone 104 and noise reference microphone 106 can be positioned in any suitable locations on wireless communication device 102.

It should be further noted that a single noise reference microphone 106 is shown in FIG. 2 for illustrative purposes only and is not intended to be limiting. Persons skilled in the relevant art(s) will recognize that wireless communication device 102 can include any reasonable number of reference microphones.

Moreover, primary speech microphone 104 and noise reference microphone 106 are respectively shown in FIGS. 1 and 2 to be included in wireless communication device 102 for illustrative purposes only. It will be recognized by persons skilled in the relevant art(s) that primary speech microphone 104 and noise reference microphone 106 can be implemented in any suitable multi-microphone system or device that operates to process audio signals for transmission, storage and/or playback to a user. For example, primary speech microphone 104 and noise reference microphone 106 can be implemented in a Bluetooth® headset, a hearing aid, a personal recorder, a video recorder, or a sound pick-up system for public speech.

Figure 3:
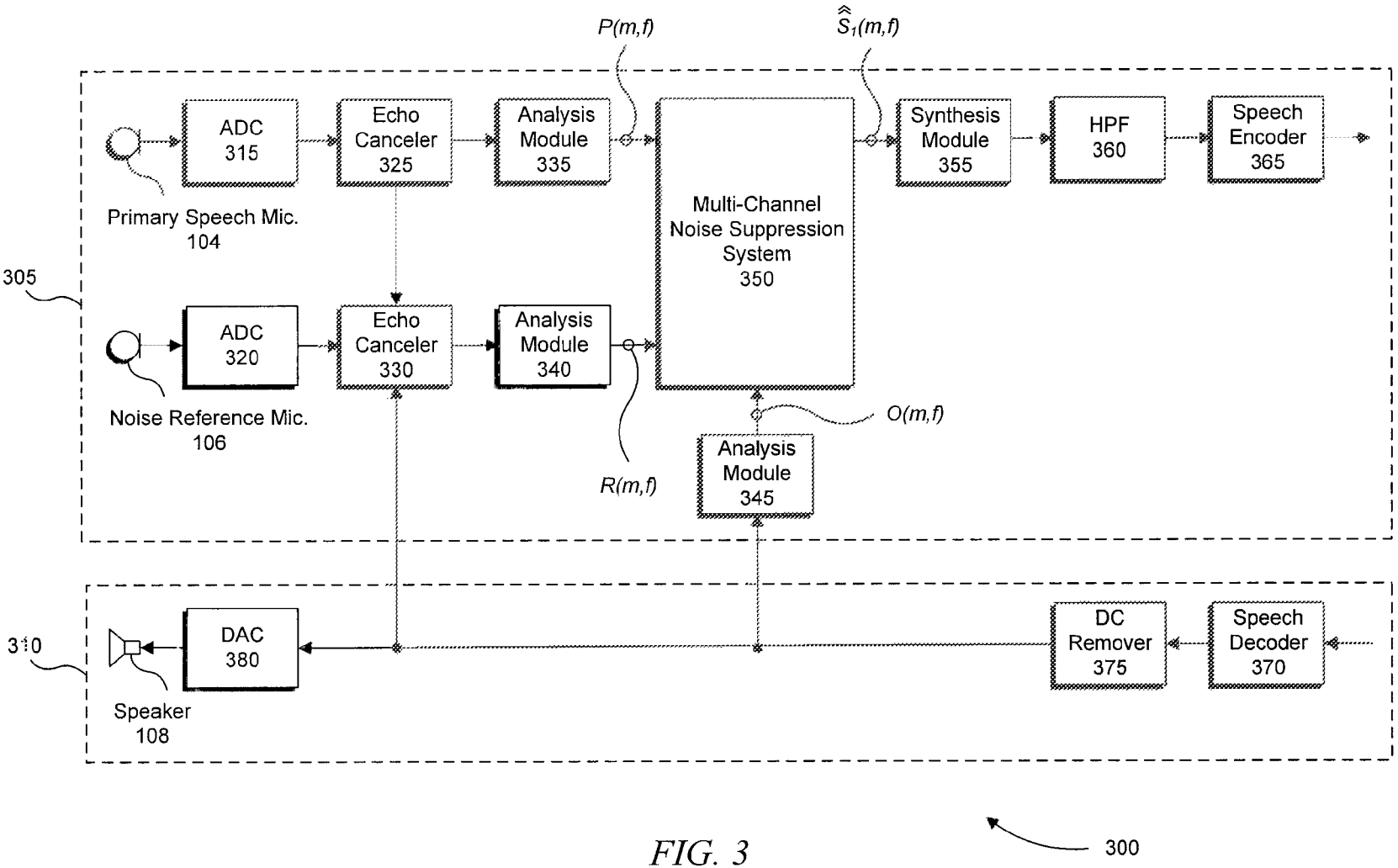
FIG. 3 illustrates a block diagram of a multi-microphone speech communication system that includes a multi-channel noise suppression system in accordance with an embodiment of the present invention.

Referring now to FIG. 3, a block diagram of a multi-microphone speech communication system 300 that includes a multi-channel noise suppression system in accordance with an embodiment of the present invention is illustrated. Speech communication system 300 can be implemented, for example, in wireless communication device 102. As shown in FIG. 3, speech communication system 300 includes an input speech signal processor 305 and, in at least one embodiment, an output speech signal processor 310.

Input speech signal processor 305 is configured to process the input speech signals received by primary speech microphone 104 and noise reference microphone 106, which are physically positioned in the general manner as described above in FIGS. 1 and 2 (i.e., with primary speech microphone 104 closer to the desired speech source during regular use than noise reference microphone 106). Input speech signal processor 305 includes analog-to-digital converters (ADCs) 315 and 320, echo cancelers 325 and 330, analysis modules 335, 340, and 345, multi-channel noise suppression system 350, synthesis module 355, high pass filter (HPF) 360, and speech encoder 365.

In operation of input speech signal processor 305, primary speech microphone 104 receives a primary input speech signal and noise reference microphone 106 receives a noise reference input speech signal. Both input speech signals may contain a desired speech component, an undesired wind noise component, and an undesired background noise component. The level of these components will generally vary over time. For example, assuming speech communication system 300 is implemented in a cellular telephone, the user of the cellular telephone may stop speaking, intermittently, to listen to a remotely located person to whom a call was placed. When the user stops speaking, the level of the desired speech component will drop to zero or near zero. In the same context, while the user is speaking, a truck may pass by creating background noise in addition to the desired speech of the user. As the truck gets farther away from the user, the level of the background noise component will drop to zero or near zero (assuming no other sources of background noise are present in the surrounding environment).

As the two continuous input speech signals are received by primary speech microphone 104 and noise reference microphone 106, they are converted to discrete time digital representations by ADCs 315 and 320, respectively. The sample rate of ADCs 315 and 320 can be determined to be equal to, or some marginal amount higher than, twice the maximum desired component frequency of the desired speech within the signals.

After being digitized by ADCs 315 and 320, the primary input speech signal and the noise reference input speech signal are respectively processed in the time-domain by echo cancelers 325 and 330. In an embodiment, echo cancelers 325 and 330 are configured to remove or suppress acoustic echo.

Acoustic echo can occur, for example, when an audio signal output by speaker 108 is picked up by primary speech microphone 104 and/or noise reference microphone 106. When this occurs, an acoustic echo can be sent back to the source of the audio signal output by speaker 108. For example, assuming speech communication system 300 is implemented in a cellular telephone, a user of the cellular telephone may be conversing with a remotely located person to whom a call was placed. En this instance, the audio signal output by speaker 108 may include speech received from the remotely located person. Acoustic echo can occur as a result of the remotely located person's speech, output by speaker 108, being picked up by primary speech microphone 104 and/or noise reference microphone 106 and feedback to him or her, leading to adverse effects that degrade the call performance.

After echo cancelation, the primary input speech signal and the noise reference input speech signal are respectively processed by analysis modules 335 and 340. More specifically, analysis module 335 is configured to process the primary input speech signal on a frame-by-frame basis, where a frame includes a set of consecutive samples taken from the time domain representation of the primary input speech signal it receives. Analysis module 335 calculates, in at least one embodiment, the Discrete Fourier Transform (DFT) of each frame to transform the frames into the frequency domain. Analysis module 335 can calculate the DFT using, for example, the Fast Fourier Transform (FFT). In general, the resulting frequency domain signal describes the magnitudes and phases of component cosine waves (also referred to as component frequencies) that make up the time domain frame, where each component cosine wave corresponds to a particular frequency between DC and one-half the sampling rate used to obtain the samples of the time domain frame.

For example, and in one embodiment, each time domain frame of the primary input speech signal includes 128 samples and can be transformed into the frequency domain using a 128-point DFT by analysis module 335. The 128-point DFT provides 65 complex values that represent the magnitudes and phases of the component cosine waves that make up the time domain frame. In another embodiment, once the complex values that represent the magnitudes and phases of the component cosine waves are obtained for a frame of the primary input speech signal, analysis module 335 can group the cosine wave components into sub-bands, where a sub-band can include one or more cosine wave components. In one embodiment, analysis module 335 can group the cosine wave components into sub-bands based on the Bark frequency scale or based on some other acoustic perception quality of the human ear (such as decreased sensitivity to higher frequency components). As is well known, the Bark frequency scale ranges from 1 to 24 Barks and each Bark corresponds to one of the first 24 critical bands of hearing. Analysis module 340 can be constructed to process the noise reference input speech signal in a similar manner as analysis module 345 described above.

The frequency domain version of the primary input speech signal and the noise reference input speech signal are respectively denoted by P(m, f) and R(m, f) in FIG. 3, where m indexes a particular frame made up of consecutive time domain samples of the input speech signal and f indexes a particular frequency component or sub-band of the input speech signal for the frame indexed by m. Thus, for example, P(1,10) denotes the complex value of the $10^{th}$ frequency component or sub-band for the $1^{st}$ frame of the primary input speech signal P(m, f). The same signal representation is true, in at least one embodiment, for other signals and signal components similarly denoted in FIG. 3.

It should be noted that in other embodiments, echo cancelers 325 and 330 can be respectively placed after analysis modules 340 and 345 and process the frequency domain input speech signal to remove or suppress acoustic echo.

Multi-channel noise suppression system 350 receives P(m, f) and R(m, f) and is configured to detect and suppress wind noise and background noise in at least P(m, f). In particular, multi-channel noise suppression system 350 is configured to exploit spatial information embedded in P(m, f) and R(m, f) to detect and suppress wind noise and background noise in P(m, f) to provide, as output, a noise suppressed primary input speech signal $\hat{S}_1(m, f)$. Further details of multi-channel noise suppression system 350 are described below in regard to FIG. 4.

Synthesis module 355 is configured to process the frequency domain version of the noise suppressed primary input speech signal $\hat{S}_1(m, f)$ to synthesize its time domain signal. More specifically, synthesis module 355 is configured to calculate, in at least one embodiment, the inverse DFT of the input speech signal $\hat{S}_1(m, f)$ to transform the signal into the time domain. Synthesis module 355 can calculate the inverse DFT using, for example, the inverse FFT.

HPF 360 removes undesired low frequency components of the time domain version of the noise suppressed primary input speech signal $\hat{S}_1(m, f)$ and speech encoder 365 then encodes the input speech signal $\hat{S}_1(m, f)$ by compressing the data of the input speech signal on a frame-by-frame basis. There are many speech encoding schemes available and, depending on the particular application or device in which speech communication system 300 is implemented, different speech encoding schemes may be better suited. For example, and in one embodiment, where speech communication system 300 is implemented in a wireless communication device, such as a cellular phone, speech encoder 365 can perform linear predictive coding, although this is just one example. The encoded speech signal is subsequently provided as output for eventual transmission over a communication channel.

Referring now to the second speech signal processor illustrated in FIG. 3, output speech signal processor 310 includes a speech decoder 370, a DC remover 375, a digital-to-analog converter (DAC) 380, and a speaker 108. This speech signal processor can be optionally included in speech communication system 300 when some type of audio feedback is, received for playback by speech communication system 300.

In operation of output speech signal processor 310, speech decoder 370 is configured to decompress an encoded speech signal received over a communication channel. More specifically, speech decoder 370 can apply any one of a number of speech decoding schemes, on a frame-by-frame basis, to the received speech signal. For example, and in one embodiment, where speech communication system 300 is implemented in a wireless communication device, such as a cellular phone, speech decoder 370 can perform decoding based on the speech signal being encoded using linear predictive coding, although this is just one example.

Once decoded, the speech signal is received by DC remover 375, which is configured to remove any DC component of the speech signal. The DC removed and decoded speech signal is then converted by DAC 380 into an analog signal for playback by speaker 108.

In an embodiment, the DC removed and decoded speech signal can be further provided to multi-channel noise suppression system 350, as illustrated in FIG. 3, to further suppress acoustic echo in the primary input speech signal P(m, f). Prior to providing the DC removed and decoded speech signal to multi-channel noise suppression system 350, the time domain signal can be converted to a frequency domain signal O(m, f) by analysis module 345, which can be constructed to operate in a similar manner as described above in regard to analysis module 335.

3. System and Method for Multi-Channel Noise Suppression

Figure 4:
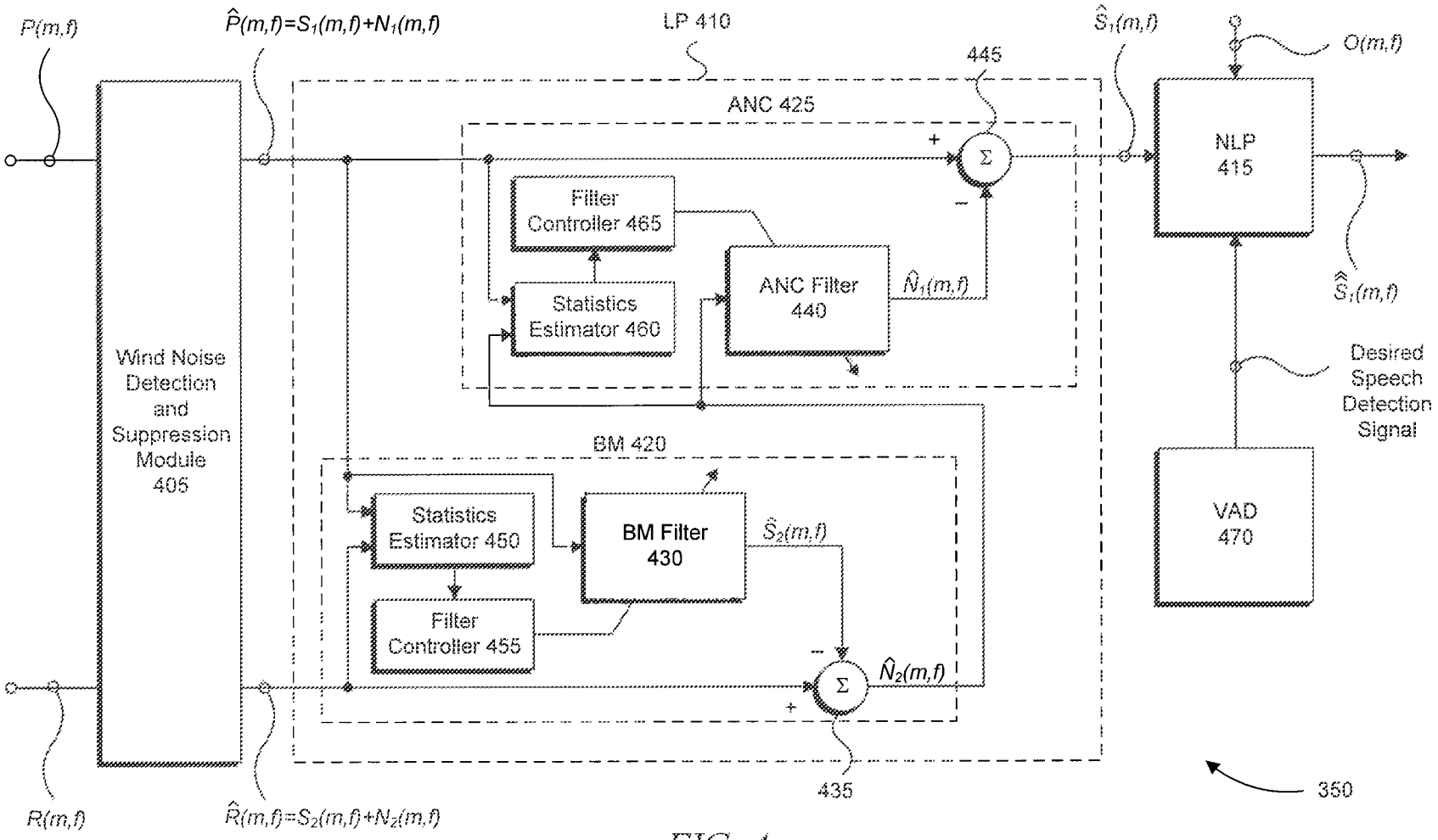
FIG. 4 illustrates a block diagram of a multi-channel noise suppression system in accordance with an embodiment of the present invention.

FIG. 4 illustrates a block diagram of multi-channel noise suppression system 350, introduced in FIG. 3, in accordance with an embodiment of the present invention. Multi-channel noise suppression system 350 is configured to detect and suppress wind and acoustic background noise in the primary input speech signal P(m, f) using the noise reference input speech signal R(m, f). As illustrated in FIG. 4, multi-channel noise suppression system 350 specifically includes a wind noise detection and suppression module 405 for detecting and suppressing wind noise, followed by two additional noise suppression modules: a linear processor (LP) 410 and a non-linear processor (NLP) 415.

Ignoring the operational details of wind noise detection and suppression module 405 for the moment, LP 410 is configured to process a wind noise suppressed primary input speech signal $\hat{P}(m, f)$ and a wind noise suppressed reference input speech signal $\hat{R}(m, f)$ to remove acoustic background noise from $\hat{P}(m, f)$ by exploiting spatial diversity with linear filters. In general, $\hat{P}(m, f)$ and $\hat{R}(m, f)$ respectively represent the residual signals of $\hat{P}(m, f)$ and $\hat{R}(m, f)$ after having undergone wind noise detection and, potentially, wind noise suppression by wind noise detection and suppression module 405. Both $\hat{P}(m, f)$ and $\hat{R}(m, f)$ contain components of the user's speech (i.e., desired speech) and acoustic background noise. However, because of the relative positioning of primary speech microphone 104 and noise reference microphone 106 with respect to the desired speech source as described above, the level of the desired speech $S_1(m, f)$ in $\hat{P}(m, f)$ is likely to be greater than a level of the desired speech $S_2(m, f)$ in $\hat{R}(m, f)$, while the acoustic background noise components $N_1(m, f)$ and $N_2(m, f)$ of each input speech signal are likely to be about equal in level.

LP 410 is configured to exploit this information to estimate filters for spatial suppression of background noise sources by filtering the wind noise suppressed primary input speech signal $\hat{P}(m, f)$ using the wind noise suppressed reference input speech signal $\hat{R}(m, f)$ to provide, as output, a noise suppressed primary input speech signal $\hat{S}_1(m, f)$. As illustrated, LP 410 specifically includes a time-varying blocking matrix (BM) 420 and a time-varying active noise canceler (ANC) 425.

Time-varying BM 420 is configured to estimate and remove the desired speech component $S_2(m, f)$ in $\hat{R}(m, f)$ to produce a "cleaner" background noise component $\hat{N}_2(m, f)$. More specifically, BM 420 includes a BM filter 430 configured to filter $\hat{P}(m, f)$ to provide an estimate of the desired speech component $S_2(m, f)$ in $\hat{R}(m, f)$ BM 420 then subtracts the estimated desired speech component $\hat{S}_2(m, f)$ from $\hat{R}(m, f)$ using subtractor 435 to provide, as output, the "cleaner" background noise component $\hat{N}_2(m, f)$.

After $\hat{N}_2(m, f)$ has been obtained, time-varying ANC 425 is configured to estimate and remove the undesirable background noise component $N_1(m, f)$ in $\hat{P}(m, f)$ to provide, as output, the noise suppressed primary input speech signal $\hat{S}_1(m, f)$. More specifically, ANC 425 includes an ANC filter 440 configured to filter the "cleaner" background noise component $\hat{N}_2(m, f)$ to provide an estimate of the background noise component $N_1(m, f)$ in $\hat{P}(m, f)$. ANC 425 then subtracts the estimated background noise component $\hat{N}_1(m, f)$ from $\hat{P}(m, f)$ using subtractor 445 to provide, as output, the noise suppressed primary input speech signal $\hat{S}_1(m, f)$.

In an embodiment, BM filter 430 and ANC filter 440 are derived using closed-form solutions that require calculation of time-varying statistics of complex signals in noise suppression system 350. More specifically, and in at least one embodiment, statistics estimator 450 is configured to estimate the necessary statistics used to derive the closed form solution for the transfer function of BM filter 430 based on $\hat{P}(m, f)$ and $\hat{R}(m, f)$, and statistics estimator 460 is configured to estimate the necessary statistics used to derive the closed form solution for the transfer function of ANC filter 440 based on $\hat{N}_2(m, f)$ and $\hat{P}(m, f)$. In general, spatial information embedded in the signals received by statistics estimators 450 and 460 is exploited to estimate these necessary statistics. After the statistics have been estimated, filter controllers 455 and 465 respectively determine and update the transfer functions of BM filter 430 and ANC filter 440.

Further details and alternative embodiments of LP 410 are set forth in U.S. patent application Ser. No. 13/295,818 to Thyssen et al., filed Nov. 14, 2011, and entitled "System and Method for Multi-Channel Noise Suppression Based on Closed-Form Solutions and Estimation of Time-Varying Complex Statistics," the entirety of which is incorporated by reference herein.

It should be noted that, although closed form solutions based on time varying statistics are used to derive the transfer functions of BM filter 430 and ANC filter 440 in FIG. 4, in other embodiments adaptive algorithms (e.g., least mean square adaptive algorithm) can be used to derive or update the transfer functions of one or both of these filters.

In at least one embodiment, and as further shown in FIG. 4, wind noise detection and suppression module 405 is configured to process primary input speech signal P(m, f) and noise reference input speech signal R(m, f) before LP 410. This is because LP module 410 works under the general assumption that primary input speech signal P(m, f) includes the same background noise and desired speech as noise reference input speech signal R(m, f), albeit subject to different acoustic channels between a source and the respective microphones. [No, this is not quite right, or at least, can easily be misunderstood]. Wind noise corruption present in one or both of primary input speech signal P(m, f) and noise reference input speech signal R(m, f) can affect the ability of LP 410 to effectively remove acoustic background noise from primary input speech signal P(m, f). Therefore, it can be important to detect and, potentially, suppress wind noise present in primary input speech signal P(m, f) and/or noise reference input speech signal R(m, f) before acoustic noise suppression is performed by LP 410 or, alternatively, forego acoustic noise suppression by LP 410 when wind noise is detected to be present (or above a certain threshold) in primary input speech signal P(m, f) and/or noise reference input speech signal R(m, f).

In U.S. patent application Ser. No. 13/250,291 to Chen et al., filed Sep. 30, 2011, and entitled "Method and Apparatus for Wind Noise Detection and Suppression Using Multiple Microphones" (the entirety of which is incorporated by reference herein), two different wind noise detection and suppression modules were disclosed, each of which presents a potential implementation for wind noise detection and suppression module 405 illustrated in FIG. 4.

Although not shown in FIG. 4, wind noise detection and suppression module 405 can provide an indication as to, or the actual value of, the level of wind noise determined to be present in primary input speech signal P(m, f) and/or noise reference input speech signal R(m, f) to LP 410. In an embodiment, LP 410 can use these indications or values to determine whether to update BM filter 430 and ANC filter 440 and/or adjust the rate at which BM filter 430 and ANC filter 440 are updated. For example, statistics estimators 455 and 460 can halt updating the statistics used to derive the transfer functions of BM filter 430 and ANC filter 440 when the indications or values from wind noise detection and suppression module 405 show that wind noise is present or above some threshold amount in segments of P(m, f) and/or R(m, f).

In another embodiment, where adaptive algorithms are used to derive BM filter 430 and ANC filter 440, adaptation of BM filter 430 and ANC filter 440 can be halted or slowed when the indications or values from wind noise detection and suppression module 405 show that wind noise is present or above some threshold amount in either P(m, f) and/or R(m, f).

In yet another embodiment, depending on the indications or values from wind noise detection and suppression module 405 regarding the amount of wind noise present in P(m, f) and/or R(m, f), ANC 425 can be bypassed and not used to perform background noise suppression on P(m, f). For example, when wind noise detection and suppression module 405 indicates that wind noise is present or above some threshold in noise reference input speech signal R(m, f), ANC 425 can be bypassed. This is because noise reference input speech signal R(m, f) has wind noise and, assuming wind noise detection and suppression module 405 cannot adequately suppress the wind noise in $\hat{R}(m, f)$, ANC 425 may not be able to effectively reduce any background noise that is present in $\hat{P}(m, f)$ using $\hat{R}(m, f)$.

However, simply bypassing ANC 425 can lead to its own problems. For example, if ANC 425 provides, on average, X dB of background noise reduction when wind noise is absent or below some threshold in both P(m, f) and R(m, f), simply turning ANC 425 off when wind noise is present or above some threshold in R(m, f) can cause the background noise level in the noise suppressed primary input speech signal $\hat{S}_1(m, f)$, provided as output by ANC 425, to be X dB higher in the regions where R(m, f) is corrupted by wind noise. If this is not dealt with, the background noise level in $\hat{S}_1(m, f)$ will modulate with the presence of wind noise in R(m, f).

To combat this problem, a single-channel noise suppression module can be further included in wind noise detection and suppression module 405 or LP 425 to perform single-channel noise suppression with X dB of target noise suppression to $\hat{P}(m, f)$ when ANC 425 is bypassed. Doing so can help to maintain a roughly constant background noise level.

Referring now to NLP 415, NLP 415 is configured to further reduce residual background noise in the noise suppressed primary input speech signal $\hat{S}_1(m, f)$ provided as output by LP 410. In general, LP 410 uses linear processing to suppress or attenuate noise sources. In practice, the noise field is highly complex with multiple noise sources and reverberations from the objects in the physical environment. The linear spatial filtering has the ability to implement spatially well-defined directions of attenuation, e.g. highly attenuate a point noise in an environment without reverberation, but is generally unable to attenuate all directions except for a well-defined direction (such as the direction of the desired source), unless a very high number of microphones is used. Hence, the noise suppressed primary input speech signal $\hat{S}_1(m, f)$, provided as output by LP 410, can have unacceptable levels of residual background noise.

For example, the above description assumes that only a single noise reference microphone is used by the multi-microphone system in which LP 410 is implemented. In this scenario, LP 410 can effectively cancel, at most, a single background noise point source from $\hat{P}(m, f)$ in an anechoic environment. Therefore, when there is more than one background noise source in the environment surrounding primary speech microphone 104 and noise reference microphone 106 or the environment is not anechoic or result in acoustic channels more complex than LP 410 is capable of modeling effectively, the noise suppressed primary input speech signal $\hat{S}_1(m, f)$ can have unacceptable levels of residual background noise.

In an embodiment, NLP 415 is configured to determine and apply a suppression gain to the noise suppressed primary input speech signal $\hat{S}_1(m, f)$ based on a difference in level between the primary input speech signal P(m, f) (or a signal indicative of the level of the primary input speech signal P(m, f)) and the noise reference input speech signal R(m, f) (or a signal indicative of the level of the noise reference input speech signal R(m, f)) to further reduce such residual background noise. The difference between the two microphone levels can provide an indication as to the amount of background noise present in the primary input speech signal P(m, f).

For example, if the level of the primary input speech signal P(m, f) (or a signal indicative of the level of the primary input speech signal P(m, f)) is much greater than the noise reference input speech signal R(m, f) (or a signal indicative of the level of the noise reference input speech signal R(m, f)), there is a strong likelihood that desired speech is present in primary input speech signal P(m, f). On the other hand, if the level of the primary input speech signal P(m, f) (or a signal indicative of the level of the primary input speech signal P(m, f)) is about the same as the level of the noise reference input speech signal R(m, f) (or a signal indicative of the level of the noise reference input speech signal R(m, f)), there is a strong likelihood that desired speech is absent in primary input speech signal P(m, f).

In one embodiment, the difference in level between the primary input speech signal P(m, f) and the noise reference input speech signal R(m, f) can be determined based on the difference between calculated signal-to-noise ratio (SNR) values for each signal.

Figure 5:
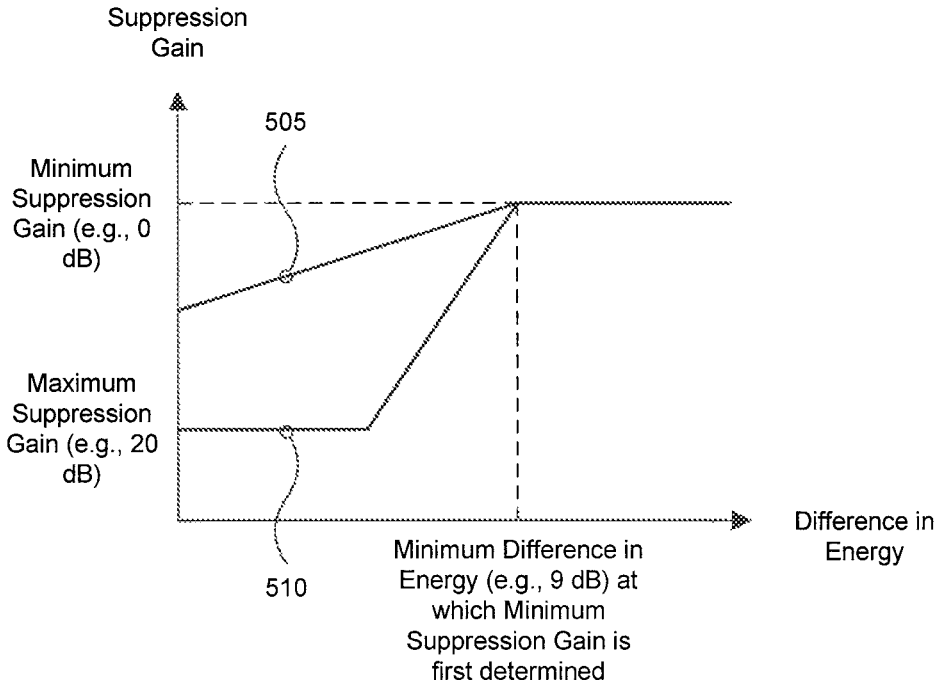
FIG. 5 illustrates plots of two exemplary functions that can be used by a non-linear processor to determine a suppression gain in accordance with an embodiment of the present invention

FIG. 5 illustrates plots of two exemplary functions 505 and 510 that can be used by NLP 415 to determine a suppression gain for a calculated difference in signal level between the primary input speech signal P(m, f) (or a signal indicative of the level of the primary input speech signal P(m, f)) and the noise reference input speech signal R(m, f) (or a signal indicative of the level of the noise reference input speech signal R(m, f)) in accordance with an embodiment of the present invention.

In general, both functions 505 and 510 provide monotonically increasing values of suppression gain for increasing values in difference in level between the primary input speech signal P(m, f) (or a signal indicative of the level of the primary input speech signal P(m, f)) and the noise reference input speech signal R(m, f) (or a signal indicative of the level of the noise reference input speech signal R(m, f)). The more aggressive function 510 can be used by NLP 415 when it is determined that desired speech is absent from the primary input speech signal P(m, f), whereas the less aggressive function 505 can be used by NLP 415 when it is determined that desired speech is present in the primary input speech signal P(m, f). In other embodiments, a single function, rather than two functions as shown in FIG. 5, can be used by NLP 415 to determine the suppression gain independent of whether desired speech is determined to be present in the primary input speech signal P(m, f).

Once a suppression gain is determined by NLP 415, the suppression gain can be smoothed in time. For example, a suppression gain determined for a current frame of the primary input speech signal P(m, f) can be smoothed across one or more suppression gains determined for previous frames of the primary input speech signal P(m, f). In addition, in the instance where NLP 415 determines suppression gains for the primary input speech signal P(m, f) on a per frequency component or per sub-band basis, the suppression gains determined by NLP 415 can be smoothed across suppression gains for adjacent frequency components or sub-bands.

To determine whether speech is present in, or absent from, the primary input speech signal P(m, f) such that either function 505 or 510 can be chosen, NLP 415 can make use of voice activity detector (VAD) 470. VAD 470 is configured to identify the presence or absence of desired speech in the primary input speech signal P(m, f) and provide a desired speech detection signal to NLP 415 that indicates whether desired speech is present in, or absent from, a particular frame of the primary input speech signal P(m, f). VAD 470 can identify the presence or absence of desired speech in the primary input speech signal P(m, f) by calculating multiple desired speech indication values, for example, the difference between the level of the primary input signal P(m, f) and the level of the noise reference input speech signal R(m, f), and further by calculation the short-term cross-correlation between the primary input signal {P(m, f)} and the noise reference input speech signal {R(m, f)}. Although not shown in FIG. 4, the primary input speech signal P(m, f) and noise reference input speech signal R(m, f) can be received by VAD 470 as inputs.

VAD 470 can indicate to NLP 415 the presence of desired speech with comparatively little or no background noise in the primary input speech signal P(m, f) if the difference between the level of the primary input signal P(m, f) and the level of the noise reference input speech signal R(m, f) is large (e.g., above some threshold value), and the short-term cross-correlation between the two input signals is high (e.g., above some threshold value).

In addition, VAD 470 can indicate to NLP 415 the presence of similar levels of desired speech and background noise is the primary input speech signal P(m, f) if the difference between the level of the primary input signal P(m, f) and the level of the noise reference input speech signal R(m, f) is small (e.g., below some threshold value), and the short-term cross-correlation between the two input signals is low (e.g., below some threshold value).

Finally, VAD 470 can indicate to NLP 415 the presence of background noise with comparatively little or no desired speech if the difference between the level of the primary input signal P(m, f) and the level of the noise reference input speech signal R(m, f) is small (e.g., below some threshold value), and the short-term cross-correlation between the two input signals is high (e.g., above some threshold value).

Although not shown in FIG. 4, wind noise detection and suppression module 405 can further provide an indication as to, or the actual value of, the level of wind noise determined to be present in primary input speech signal P(m, f) and/or noise reference input speech signal R(m, f) to NLP 415. In an embodiment, NLP 415 can use these indications or values to further determine suppression gains for the noise suppressed primary input speech signal $\hat{S}_1(m, f)$, provided as output by LP 410. For example, for a segment of the primary input speech signal P(m, f) indicated as being corrupted by wind noise, NLP 415 can determine and apply an aggressive suppression gain to the corresponding segment of the noise suppressed primary input speech signal $\hat{S}_1(m, f)$.

4. Example Computer System Implementation

It will be apparent to persons skilled in the relevant art(s) that various elements and features of the present invention, as described herein, can be implemented in hardware using analog and/or digital circuits, in software, through the execution of instructions by one or more general purpose or special-purpose processors, or as a combination of hardware and software.

Figure 6:
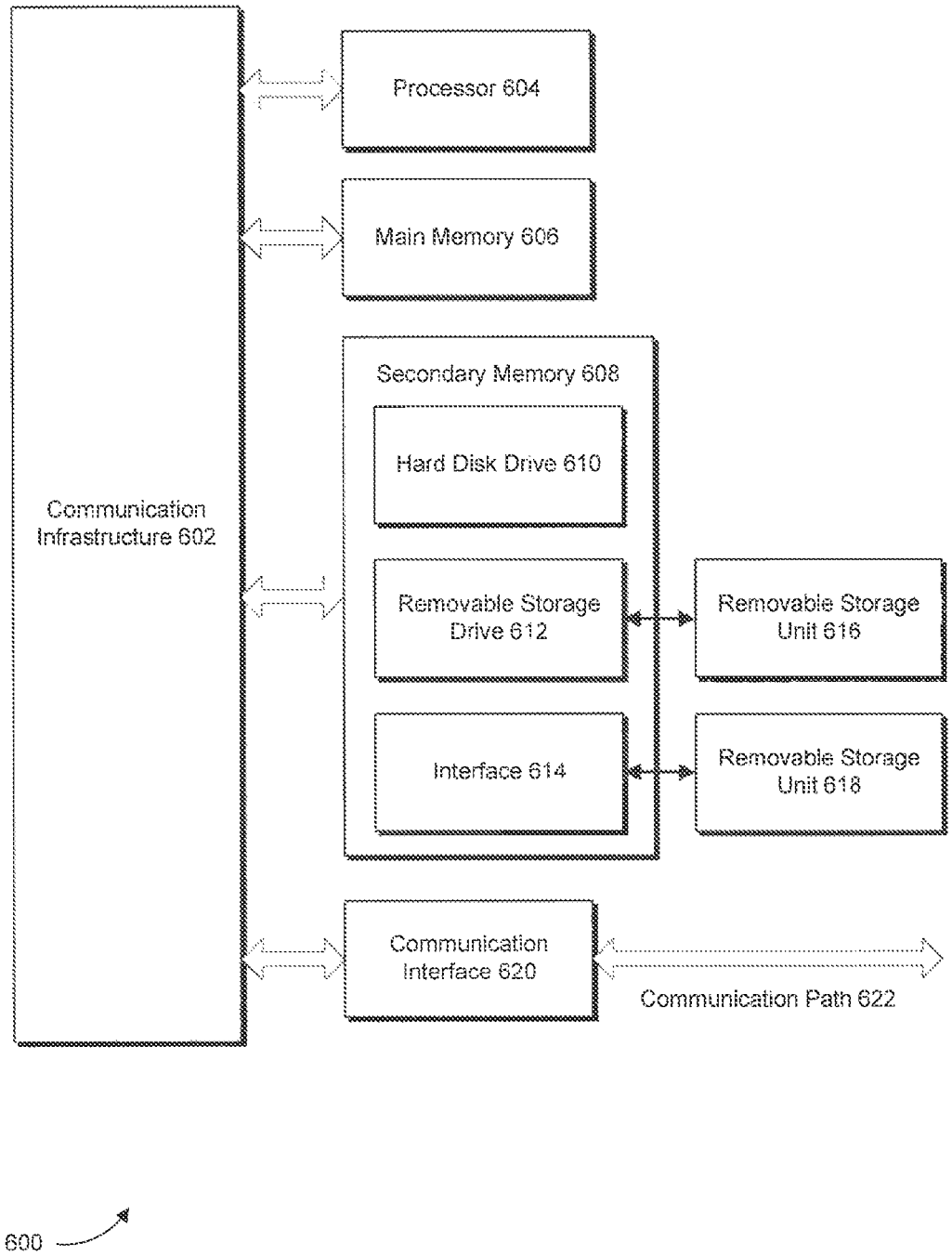
FIG. 6 illustrates a block diagram of an example computer system that can be used to implement aspects of the present invention.

The following description of a general purpose computer system is provided for the sake of completeness. Embodiments of the present invention can be implemented in hardware, or as a combination of software and hardware. Consequently, embodiments of the invention may be implemented in the environment of a computer system or other processing system. An example of such a computer system 600 is shown in FIG. 6. All of the modules depicted in FIGS. 3 and 4 can execute on one or more distinct computer systems 600.

Computer system 600 includes one or more processors, such as processor 604. Processor 604 can be a special purpose or a general purpose digital signal processor. Processor 604 is connected to a communication infrastructure 602 (for example, a bus or network). Various software implementations are described in terms of this exemplary computer system. After reading this description, it will become apparent to a person skilled in the relevant art(s) how to implement the invention using other compute systems and/or computer architectures.

Computer system 600 also includes a main memory 606, preferably random access memory (RAM), and may also include a secondary memory 608. Secondary memory 608 may include, for example, a hard disk drive 610 and/or a removable storage drive 612, representing a floppy disk drive, a magnetic tape drive, an optical disk drive, or the like. Removable storage drive 1212 reads from and/or writes to a removable storage unit 616 in a well-known manner. Removable storage unit 616 represents a floppy disk, magnetic tape, optical disk, or the like, which is read by and written to by removable storage drive 612. As will be appreciated by persons skilled in the relevant art(s), removable storage unit 616 includes a computer usable storage medium having stored therein computer software and/or data.

In alternative implementations, secondary memory 608 may include other similar means for allowing computer programs or other instructions to be loaded into computer system 600. Such means may include, for example, a removable storage unit 618 and an interface 614. Examples of such means may include a program cartridge and cartridge interface (such as that found in video game devices), a removable memory chip (such as an EPROM, or PROM) and associated socket, a thumb drive and USB port, and other removable storage units 618 and interfaces 614 which allow software and data to be transferred from removable storage unit 618 to computer system 600.

Computer system 600 may also include a communications interface 620. Communications interface 620 allows software and data to be transferred between computer system 600 and external devices. Examples of communications interface 620 may include a modem, a network interface (such as an Ethernet card), a communications port, a PCMCIA slot and card, etc. Software and data transferred via communications interface 620 are in the form of signals which may be electronic, electromagnetic, optical, or other signals capable of being received by communications interface 620. These signals are provided to communications interface 620 via a communications path 622. Communications path 622 carries signals and may be implemented using wire or cable, fiber optics, a phone line, a cellular phone link, an RF link and other communications channels.

As used herein, the terms "computer program medium" and "computer readable medium" are used to generally refer to tangible storage media such as removable storage units 616 and 618 or a hard disk installed in hard disk drive 610. These computer program products are means for providing software to computer system 600.

Computer programs (also called computer control logic) are stored in main memory 606 and/or secondary memory 608. Computer programs may also be received via communications interface 620. Such computer programs, when executed, enable the computer system 600 to implement the present invention as discussed herein. In particular, the computer programs, when executed, enable processor 604 to implement the processes of the present invention, such as any of the methods described herein. Accordingly, such computer programs represent controllers of the computer system 600. Where the invention is implemented using software, the software may be stored in a computer program product and loaded into computer system 600 using removable storage drive 612, interface 614, or communications interface 620.

In another embodiment, features of the invention are implemented primarily in hardware using, for example, hardware components such as application-specific integrated circuits (ASICs) and gate arrays. Implementation of a hardware state machine so as to perform the functions described herein will also be apparent to persons skilled in the relevant art(s).

6. Conclusion

The present invention has been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

In addition, while various embodiments have been described above, it should be understood that they have been presented by way of example only, and not limitation. It will be understood by those skilled in the relevant art(s) that various changes in form and details can be made to the embodiments described herein without departing from the spirit and scope of the invention as defined in the appended claims. Accordingly, the breadth and scope of the present invention should not be limited by any of the above-described exemplary embodiments, but should be defined only in accordance with the following claims and their equivalents.

What is claimed is:

1. A system for suppressing noise in a primary input speech signal that comprises a first desired speech component and a first background noise component using a noise reference input speech signal that comprises a second desired speech component and a second background noise component, the system comprising:

a blocking matrix configured to filter the primary input speech signal in accordance with a first transfer function to estimate the second desired speech component and to remove the estimate of the second desired speech component from the noise reference input speech signal to provide an adjusted second background noise component;

an adaptive noise canceler configured to filter the adjusted second background noise component in accordance with a second transfer function to estimate the first background noise component and to remove the estimate of the first background noise component from the primary input speech signal to provide a noise suppressed primary input speech signal; and a non-linear processor configured to apply a suppression gain to the noise suppressed primary input speech signal, wherein the suppression gain is determined based on a difference between a level of the primary input speech signal, or a signal indicative of the level of the primary input speech signal, and a level of the noise reference input speech signal, or a signal indicative of the level of the noise reference input speech signal.

2. The system of claim 1, wherein the blocking matrix and the adaptive noise canceler are further configured to adjust a rate at which the first transfer function and the second transfer function are updated based on a presence of wind noise in the primary input speech signal.

3. The system of claim 2, further comprising:

a wind noise detection and suppression module configured to detect the presence of wind noise in the primary input speech signal.

4. The system of claim 1, wherein:

the blocking matrix is further configured to determine the first transfer function based on first statistics estimated from the primary input speech signal and the noise reference input speech signal, and the adaptive noise canceler is further configured to determine the second transfer function based on second statistics estimated from the primary input speech signal and the adjusted second background noise component.

5. The system of claim 4, wherein the blocking matrix and the adaptive noise canceler are further configured to adjust a rate at which the first statistics and the second statistics are updated based on a presence of wind noise in the primary input speech signal.

6. The system of claim 5, wherein the blocking matrix and the adaptive noise canceler are further configured to halt updating the first statistics and the second statistics based on the presence of wind noise in the primary input speech signal.

7. The system of claim 1, wherein the non-linear processor is further configured to apply the suppression gain to a single frequency component or sub-band of the noise suppressed primary input speech signal.

8. The system of claim 7, wherein the non-linear processor is further configured to smooth the suppression gain over time and in frequency.

9. The system of claim 1, wherein the suppression gain is adaptively adjusted based on the likelihood of desired speech.

10. The system of claim 1, wherein the non-linear processor is further configured to determine the difference between the level of the primary input speech signal and the level of the noise reference input speech signal based on the difference between calculated signal-to-noise ratio values for the primary input speech signal and the noise reference input speech signal.

11. The system of claim 1, further comprising:

a voice activity detector configured to detect a presence or absence of desired speech in the primary input speech signal based on a plurality of calculated speech indication values.

12. The system of claim 11, wherein the non-linear processor is further configured to adaptively adjust the suppression gain based on whether the presence or absence of desired speech in the primary input signal was detected by the voice activity detector.

13. A method for suppressing noise in a primary input speech signal that comprises a first desired speech component and a first background noise component using a noise reference input speech signal that comprises a second desired speech component and a second background noise component, the method comprising:

filtering the primary input speech signal in accordance with a first transfer function to estimate the second desired speech component;

removing the estimate of the second desired speech component from the noise reference input speech signal to provide an adjusted second background noise component;

filtering the adjusted second background noise component in accordance with a second transfer function to estimate the first background noise component;

removing the estimate of the first background noise component from the primary input speech signal to provide a noise suppressed primary input speech signal; and determining a suppression gain to apply to the noise suppressed primary input speech signal, wherein the suppression gain is determined based on a difference between a level of the primary input speech signal, or a signal indicative of the level of the primary input speech signal, and a level of the noise reference input speech signal, or a signal indicative of the noise reference input speech signal.

14. The method of claim 13, wherein the first transfer function and the second transfer function are updated at a rate determined based on a presence of wind noise in the primary input speech signal.

15. The method of claim 13, further comprising:

determining the first transfer function based on first statistics estimated from the primary input speech signal and the noise reference input speech signal, and determining the second transfer function based on second statistics estimated from the primary input speech signal and the adjusted second background noise signal.

16. The method of claim 15, further comprising:

adjusting a rate at which the first statistics and the second statistics are updated based on at least a presence of wind noise in the primary input speech signal.

17. The method of claim 16, further comprising:

halting updating the first statistics and the second statistics based on the presence of wind noise in the primary input speech signal.

18. The method of claim 13, further comprising:

applying the suppression gain to a first frequency component or a first sub-band of the noise suppressed primary input speech signal.

19. The method of claim 18, further comprising:

smoothing the suppression gain over time and in frequency.

20. The method of claim 13, wherein the suppression gain is adaptively adjusted based on the likelihood of desired speech.

21. The method of claim 13, further comprising:

determining the difference between the level, of the primary input speech signal and the level of the noise reference input speech signal based on the difference between calculated signal-to-noise ratio values for the primary input speech signal and the noise reference input speech signal.

22. The method of claim 13, further comprising:

detecting a presence or absence of desired speech in the primary input speech signal based on a plurality of calculated speech indication values.

23. The method of claim 22, further comprising:

adaptively adjusting the suppression gain based on whether the presence or absence of desired speech in the primary input signal was detected by the voice activity detector.

24. A system for suppressing noise in a primary input speech signal that comprises a first desired speech component and a first background noise component using a noise reference input speech signal that comprises a second desired speech component and a second background noise component, the system comprising:

a blocking matrix configured to filter the primary input speech signal to estimate the second desired speech component and to remove the estimate of the second desired speech component from the noise reference input speech signal to provide an adjusted second background noise component;

an adaptive noise canceler configured to filter the adjusted second background noise component to estimate the first background noise component and to remove the estimate of the first background noise component from the primary input speech signal to provide a noise suppressed primary input speech signal; and a non-linear processor configured to apply a suppression gain to the noise suppressed primary input speech signal determined based on the primary input speech signal and the noise reference input speech signal.

* * * * *

UNITED STATES PATENT AND TRADEMARK OFFICE

CERTIFICATE OF CORRECTION

PATENT NO. : 8,977,545 B2
APPLICATION NO. : 13/295889
DATED : March 10, 2015
INVENTOR(S) : Huaiyu Zeng et al.

It is certified that error appears in the above-identified patent and that said Letters Patent is hereby corrected as shown below:

In the Claims,

Column 16, line 15 please replace “level, of” with --level of--

Signed and Sealed this
Eighth Day of September, 2015

Michelle K. Lee

Michelle K. Lee
*Director of the United States Patent and Trademark Office*